US006009287A

United States Patent [19]

Goldie

[11] Patent Number: 6,009,287

[45] **Date of Patent: *Dec. 28, 1999**

[54] REMOVABLE SHIPPING SEAL FOR A TONER CARTRIDGE AND METHOD FOR EMPLOYING THE SAME

[75] Inventor: Glenn C. Goldie, Tariffville, Conn.

[73] Assignee: Clarity Imaging Technologies, Inc., Springfield, Mass.

[ * ] Notice: This patent is subject to a terminal disclaimer.

[21] Appl. No.: 09/071,014

[22] Filed: May 1, 1998

Related U.S. Application Data

[63] Continuation-in-part of application No. 08/601,952, Feb. 13, 1996, Pat. No. 5,749,026.

[51] Int. Cl.[6] ..... G03G 15/08

[52] U.S. Cl. ..... 399/103; 399/106

[58] Field of Search ..... 399/102, 103, 399/105, 106

[56] References Cited

U.S. PATENT DOCUMENTS

| | | | |
|---|---|---|---|
| 4,742,797 | 5/1988 | Barker | 399/105 |
| 5,080,745 | 1/1992 | Paull | 399/102 X |
| 5,235,130 | 8/1993 | Demoto et al. | 399/103 |
| 5,258,814 | 11/1993 | Davies | 399/105 |
| 5,264,901 | 11/1993 | Rossiter | 399/105 |
| 5,296,902 | 3/1994 | Michlin | 355/260 |
| 5,488,462 | 1/1996 | Ishikawa et al. | 399/103 |
| 5,592,268 | 1/1997 | Uehard et al. | 399/103 X |
| 5,749,026 | 5/1998 | Goldie | 399/103 |

FOREIGN PATENT DOCUMENTS

| | | |
|---|---|---|
| 0 261 643 | 3/1988 | European Pat. Off. . |
| 04034467 | 2/1992 | Japan . |
| 08062976 | 3/1996 | Japan . |

*Primary Examiner*—Fred L Braun
*Attorney, Agent, or Firm*—William A. Loginov

[57] ABSTRACT

A seal for a printer toner cartridge, and a method for employing the seal is provided. The seal provides a flexible thin sheet material that can be folded to form two plies. The thin sheet material defines a seal that is wrapped around the developer roller of the toner cartridge so that a portion of the sheet material extends outwardly from the toner cartridge and can include a pull tab. The sheet material fills gaps formed between the developer roller and a doctor blade and also between the developer roller and a toner application roller. An additional layer is preferably provided to the seal, and joined adjacent the pull tab. It passes through a gap defined between the application roller and another roller, such as a primary charge roller. In addition a compressible strip may be provided between layers of the seal for enhancing the seal. By sealing these gaps, a positive barrier to toner expulsion is created. The seal is easily removed by pulling on the pull tab to slide it over and away from the developer roller. The seal can include foam projections for enhanced sealing at the walls of the cartridge that can be formed from a polymer such as polyethylene.

19 Claims, 9 Drawing Sheets

REMOVABLE SHIPPING SEAL FOR A TONER CARTRIDGE AND METHOD FOR EMPLOYING THE SAME

RELATED APPLICATION

This application is a continuation in part of U.S. application Ser. No. 08/601,952 filed Feb. 13, 1996 now U.S. Pat. No. 5,749,026.

FIELD OF THE INVENTION

This invention relates to a seal that prevents toner from leaking from a toner cartridge during shipment.

BACKGROUND OF THE INVENTION

Most modem laser printers and an increasing number of faxes, copiers and other image-transfer devices utilize self-contained, replaceable toner cartridges. These cartridges include a tank or tanks filled, typically, with a one-part toner, a toner metering system that includes a developer roller and a photosensitive drum. Such cartridges are disposable, but are sufficiently complex so that they are normally recycled after the toner supply in the tank or tanks is exhausted.

A continuing annoyance that plagues both new and remanufactured toner cartridges is the leakage of toner during shipment. Various techniques have been employed to limit toner leakage. Most of these techniques involve the placement of a removable seal adjacent the outlet of the toner tank. During shipment, toner particles, which are sized a few microns or less, act almost as a fluid, tending to slosh about the tank and exhibit hydraulic pressure-like effects. During rough shipment, the pressure often defeats the loosely attached seals. Additionally, dropping the cartridge, subsequent to arrival can also lead to significant toner leakage. The leaking cartridge thus, may be covered in wasted toner before it is installed, soiling the printer interior and the installer.

FIG. 1 illustrates a seal utilized, in particular, in IBM Series 4019/14028/4029/40391/4049 printer cartridges. The toner tank 20 and developer roller structure 22 are shown separated from the remaining cartridge shell and photosensitive drum, which are normally attached, but have been omitted for clarity. The tank 20 includes a rotating agitator 24 to which the seal strip 26 is joined at one end 28. The seal strip 26 lays along the feed slot 30 of the tank 20 that leads into the developer roller structure 22. A series of metering rollers (not shown) are provided within the developer roller structure 22 for dispensing a predetermined quantity of toner from the tank 20 into the developer roller structure 22. These metering rollers will be described further below.

The prior art seal 26 is attached over the slot 30 with a low-tack contact adhesive. When the agitator 24 rotates, in response to the gear wheel 32 (shown in phantom), during operation of the printer, it rolls the seal 26 onto the axle 33 of the agitator 24, separating it from the slot 30. The rolled-up seal remains twisted around the agitator 24 throughout the subsequent operation of the cartridge. An advantage of the self-removing seal 26 is that it is automatically removed upon start-up of the printer without intervention by the operator. However, a major disadvantage is that the seal is, by necessity, only lightly adhered to the slot 30. It is, thus, prone to leakage and rupture during shipment. In addition, the far end 34 of the slot 30, adjacent the attached end 28 of the seal 26 is often poorly seated against the slot 30 and provides a ready opening through which toner can leak.

Thus, the prior art seal system of FIG. 1 exhibits several weaknesses that limit its effectiveness. The seal 26, which is generally constructed from a piece of relatively thick fabric ribbon takes up room inside the tank, reducing the amount of toner that can be placed within the tank 20. The seal 26, due to its weak adhesion to the slot 30, cannot withstand a strong pulse of hydraulic pressure which could result from a completely filled toner tank. Thus, toner levels are usually maintained at only approximately ¾ of the tank capacity to reduce; "pressures" within the tank during rough handling.

Attempts have been made to overcome the disadvantages of the self-removing seal shown in FIG. 1 by providing an operator-removed seal (not shown) having a pull tab that exits the tank. The operator pulls the tab, which removes a more-securely adhered seal from the tank feed slot. However, this seal is still prone to leakage and the exit hole through which the pull tab is located provides yet another passage for toner leakage. In addition, the cartridge can be installed and operated without removing this type of seal and substantial time, and paper, can be wasted before the operator realizes that the seal has not yet been removed, since the cartridge can run with the seal still in place.

It is, therefore, an object of this invention to provide a toner cartridge seal that provides a more-reliable and positive seal during shipment. This seal should enable the toner tank to be filled further and should resist outward pressures of toner during rough handling. The seal should be located so that its presence is obvious to an operator, and should be easily removable prior to installation of the cartridge within a print engine. Finally, the seal should be easy to install during manufacture of the cartridge and inexpensive and easy to manufacture.

SUMMARY OF THE INVENTION

A toner cartridge seal according to this invention, overcomes the disadvantages of the prior art by providing a seal that firmly engages impinging surfaces at the developer roller across the entire surface of the developer roller. As such, this seal forms a "final barrier" to toner leakage. In its simplest form, the seal is constructed from a thin sheet of material that is wrapped around the developer roller.

In one embodiment, this invention provides a toner cartridge seal that is located to seal the metering system of the cartridge. The metering system includes, generally, metering roller having a predetermined width and closely spaced surfaces adjacent the metering roller. The seal is constructed from a thin sheet material that is sized and arranged to wrap around the metering roll with opposing side edges that are spaced apart a distance that is approximately equal to the predetermined width of the metering roller. The thin sheet material has a thickness that, when wrapped around the metering roller in a predetermined orientation, spans a gap formed between a surface of the metering roller and the closely-spaced surfaces to seal each gap against passage of toner therethrough.

One of the closely-spaced surfaces can comprise a doctor blade. Another closely spaced surface can comprise a resilient toner application roller. The metering roller can be a developer roller according to this embodiment. The thin sheet material can comprise a flexible polymer, such as polyethylene. The thin sheet material can be constructed in two plies and can include soft pliable projections, such as foam, that extend outwardly beyond the side edges of the sheet to seal against walls of the toner cartridge. Such projections are typically located at a gap formed along the doctor blade. The toner cartridge can further include a D-roller located in communication with a slot of a toner tank in the cartridge. The D-roller provides metered amounts of toner to the foam application roller.

A method for removably sealing a toner cartridge having an photosensitive drum and a toner metering system that delivers toner to the photosensitive drum is also provided. This method includes the step of locating a thin sheet material in engagement with gaps defined in the metering system. This metering system can comprise a developer roller and the gaps can be formed between the developer roller and a doctor blade and between the developer roller and an impinging resilient toner application roller. The thin sheet material can be located so that a free end of the thin sheet material is positioned outwardly of the photosensitive drum. The thin sheet material is selectively removed from the gaps by pulling on the free end in a direction outwardly away from the photosensitive drum so that the sheets slidably passes out of the gaps.

The step of locating the thin sheet material can include wrapping the thin sheet material around the developer roller. Additionally, the step of locating can include positioning a pair of crushable projections, that comprise foam, in engagement with opposing sidewalls of the toner cartridge to seal a space between the side edges of the thin sheet material and the sidewalls adjacent the doctor blade.

According to another embodiment the seal can comprise two plies having therebetween, at a desired location, a strip of compressible material. Thin foam can be used as the compressible material in one embodiment. The compressible material is located so that, when the seal is installed in the cartridge around the developer roller, the compressible material is located at an impingement point between the developer roller and another of the rollers to further enhance the sealing of the cartridge by providing a positive elastic force to each of the two plies of the seal against respective roller surfaces. In a preferred embodiment, the impingement point can be a point between the developer roller and a foam application roller.

Insertion and removal of the seal can be accomplished using a flexible shim composed of spring steel or a similar resilient material that flexes easily to "snake" around the developer roller. The shim has a hook shape to enhance its snaking around the developer roller and carries over itself the two plies of the seal.

In yet another embodiment, the seal, of any type described hereinabove, can include an additional layer that extends widthwise across the width of the cartridge and that is joined adjacent a pull tab end of the seal. The additional layer is constructed and arranged to pass between another impingement point formed between the photosensitive drum and, for example, a primary charge roller. In one embodiment this seal prevents undesirable chemical reation between the photosensitive drum and the primary charge roller during long term storage. The layer can include various shielding and/or insulation materials coated thereover to further prevent an undesirable chemical reaction therebetween.

BRIEF DESCRIPTION OF THE DRAWINGS

The foregoing and other objects and advantages of the invention will become more clear with reference to the following detailed description as illustrated by the drawings in which.

DETAILED DESCRIPTION

Figure 1:
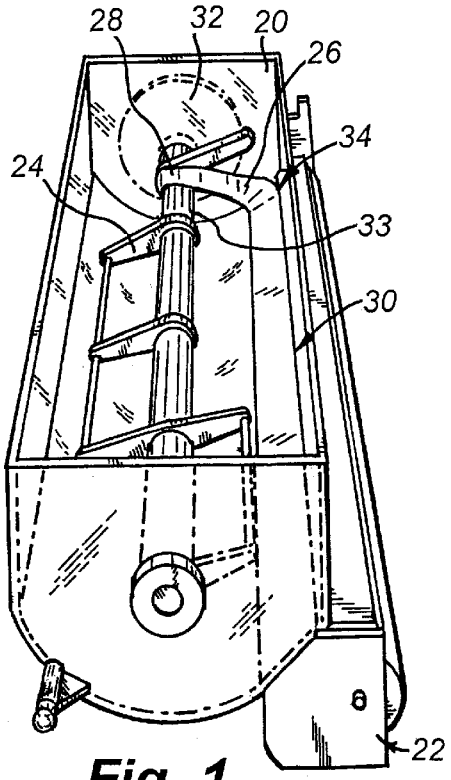
Fig. 1 (PRIOR ART)
FIG. 1 is an exposed perspective view of a toner tank and developer roller system having a self-removing seal according to the prior art.
Figure 2:
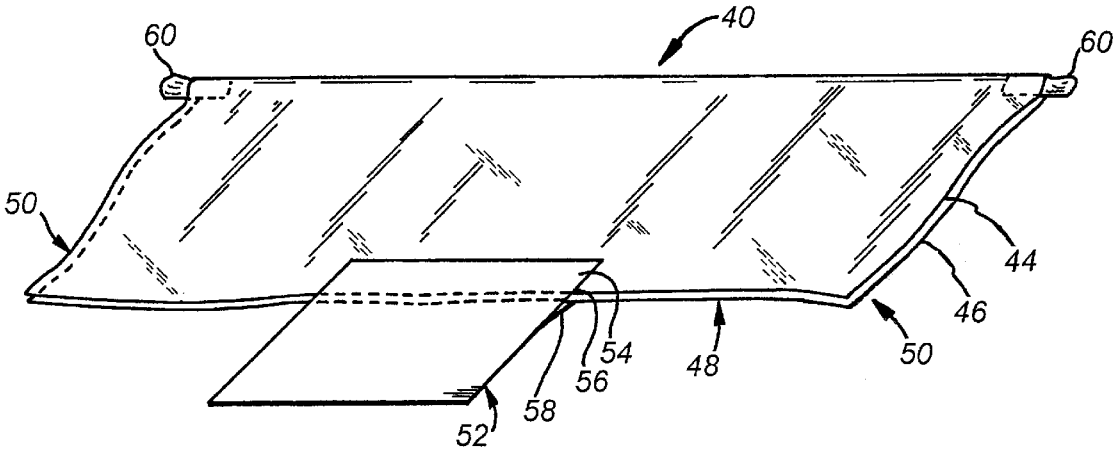
FIG. 2 is a perspective view of a printer toner cartridge seal according to this invention.
Figure 3:
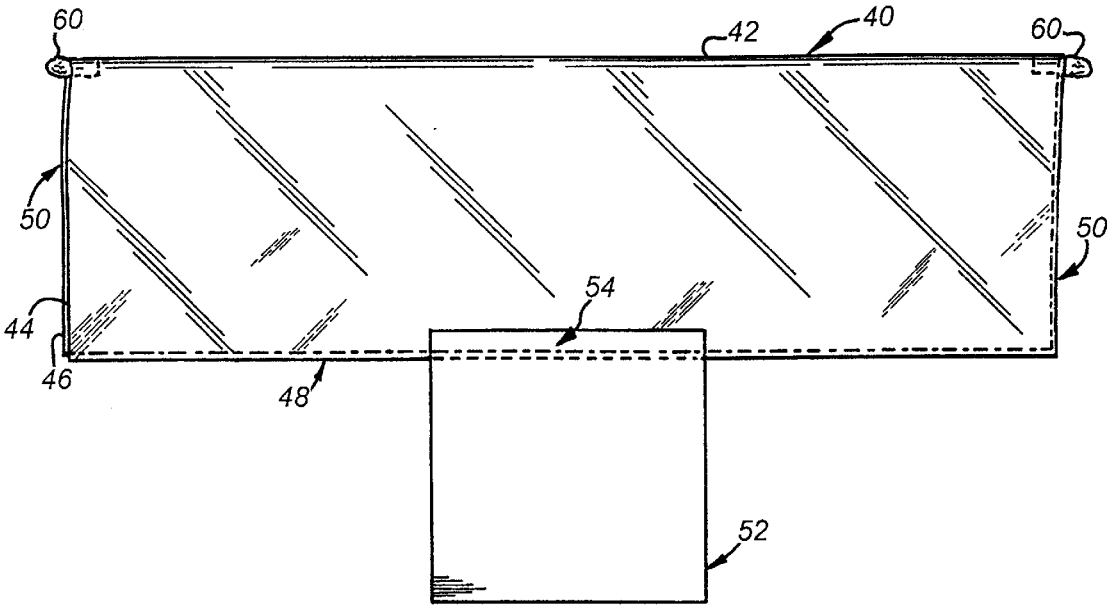
FIG. 3 is a plan view of the printer toner cartridge seal of FIG. 2.

A toner cartridge seal according to a preferred embodiment of this invention is detailed in FIGS. 2 and 3. The seal 40, according to this embodiment, comprises a six mil transparent polyethylene sheet folded along fold line 42 to define two equally dimensioned plies 44 and 46 that are open along their front edge 48 and side edges 50. A pull tab 52 is adhered along the front edge 48. The pull tab 52 can also comprise a paper or synthetic sheet material that is adhered along a common overlapping section 54 to the two-ply faces 44 and 46. As detailed in FIG. 2, the tab 52 can comprise two plies 56 and 58 of material. For example, the two plies 56 and 58 can comprise opposing adhesive sheets that are joined in a face-to-face relationship for a permanent joint. Alternatively, the pull tab can comprise an extension of the front edge 48 of the seal plies 44 and 46. This form of integral pull tab is described below with reference to another embodiment.

Adjacent the fold line 42, projecting from each of the side edges 50, are small segments of foam 60 or a similar soft, pliable material. In this embodiment, the foam comprises a conventional synthetic closed-cell foam that can be self-adhering. Such foam is available from a variety of commercial sources. The foam has a thickness of approximately 1/16 inch and has a width, taken along the respective side edge 50 of approximately 1/8 inch. The foam projections 60 extend outwardly from each side edge 50 a distance that is also approximately 1/8 inch.

Figure 4:
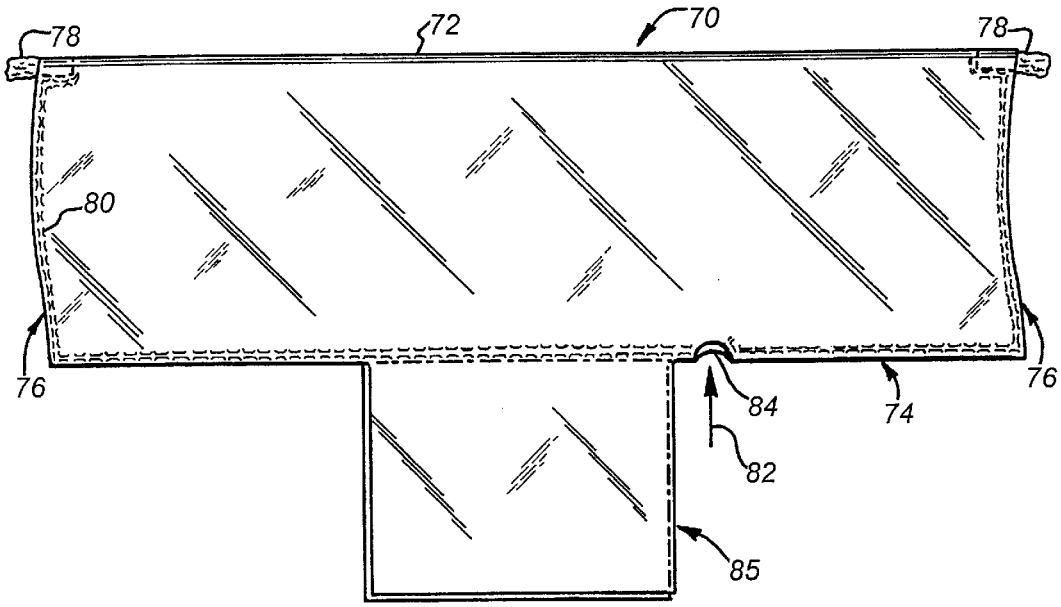
FIG. 4 is an inflatable printer toner cartridge seal according to an alternate embodiment of this invention.

FIG. 4 illustrates an alternate embodiment of the seal according to this invention. The seal 70 is also formed from a two-ply polymer material according to this embodiment. It includes a rear fold edge 72, a front edge 74, and side edges 76. It also includes respective foam projections 78 that extend from the side edges 76 at the rear fold edge 72. The two plies of the seal 70 according to this embodiment are joined by heat seals, cement, or other crimping processes along a continuous seam 80. In this embodiment, the seam 80 is constructed so that air cannot infiltrate through it. Such a seam can be constructed using, for example, conventional heat sealing devices for use with plastic bags and wrapping material. The seam 80 extends to the fold edge 72 and follows the side edges 76 and front edge 74 to an opening 84 formed along the front edge 74. The opening 84 remains unsealed in this embodiment so that air or another pressurized gas can be inserted (arrow 82) between the two plies to create an inflated region between the two plies. As will be described further below, such inflation can improve sealing under certain circumstances. The opening 84 is designed to be sealed subsequent to application of air. Note that the foam projections 78 remain outside the seam 80 so that a positive air seal can be maintained between the plies of the seal 70.

In the embodiment of FIG. 4, the pull tab 85 is an integral extension of the front edge giving the seal 70 a "T-shaped" appearance. Any of the seals shown and described herein can be provided with an integral pull tab.

Figure 5:
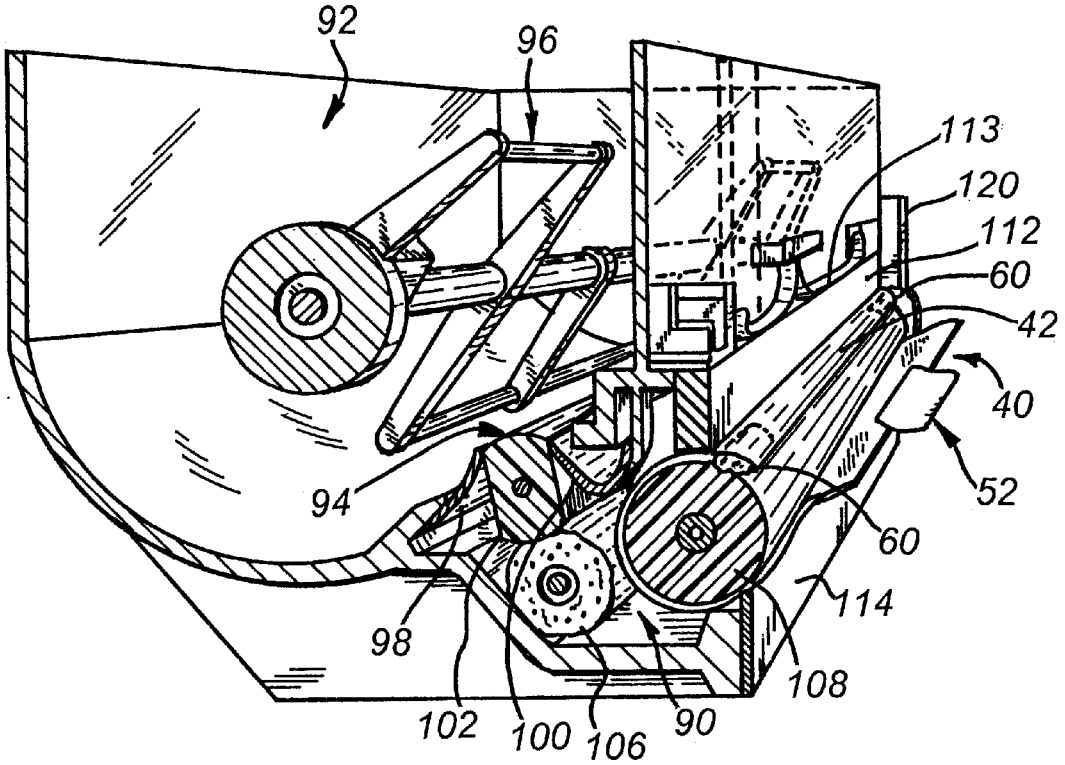
FIG. 5 is a cross-sectional perspective view of a toner tank and developer roller assembly employing a seal according to this embodiment.
Figure 6:
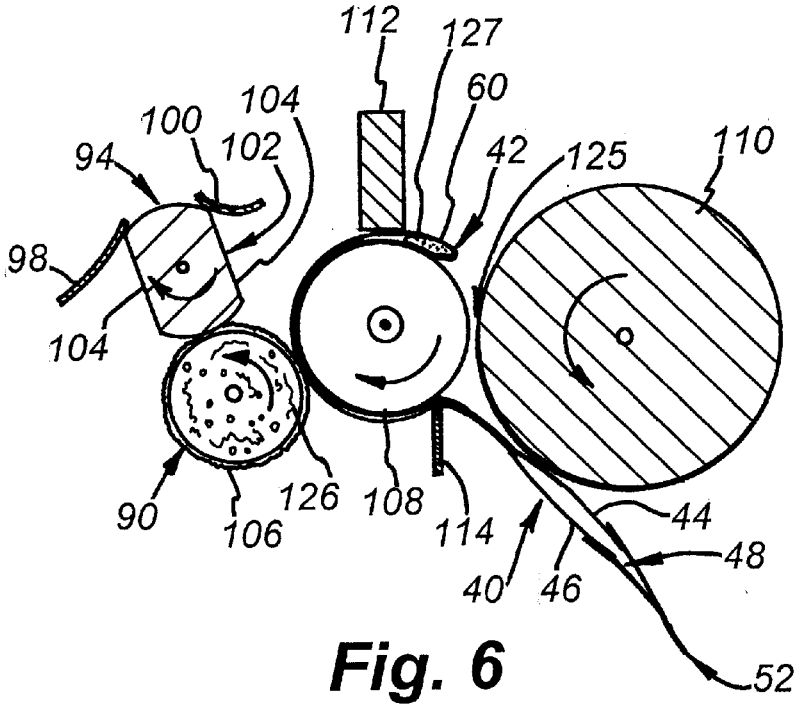
FIG. 6 is a partial side cross-section of the seal of FIG. 5 engaging the developer roller assembly.
Figure 7:
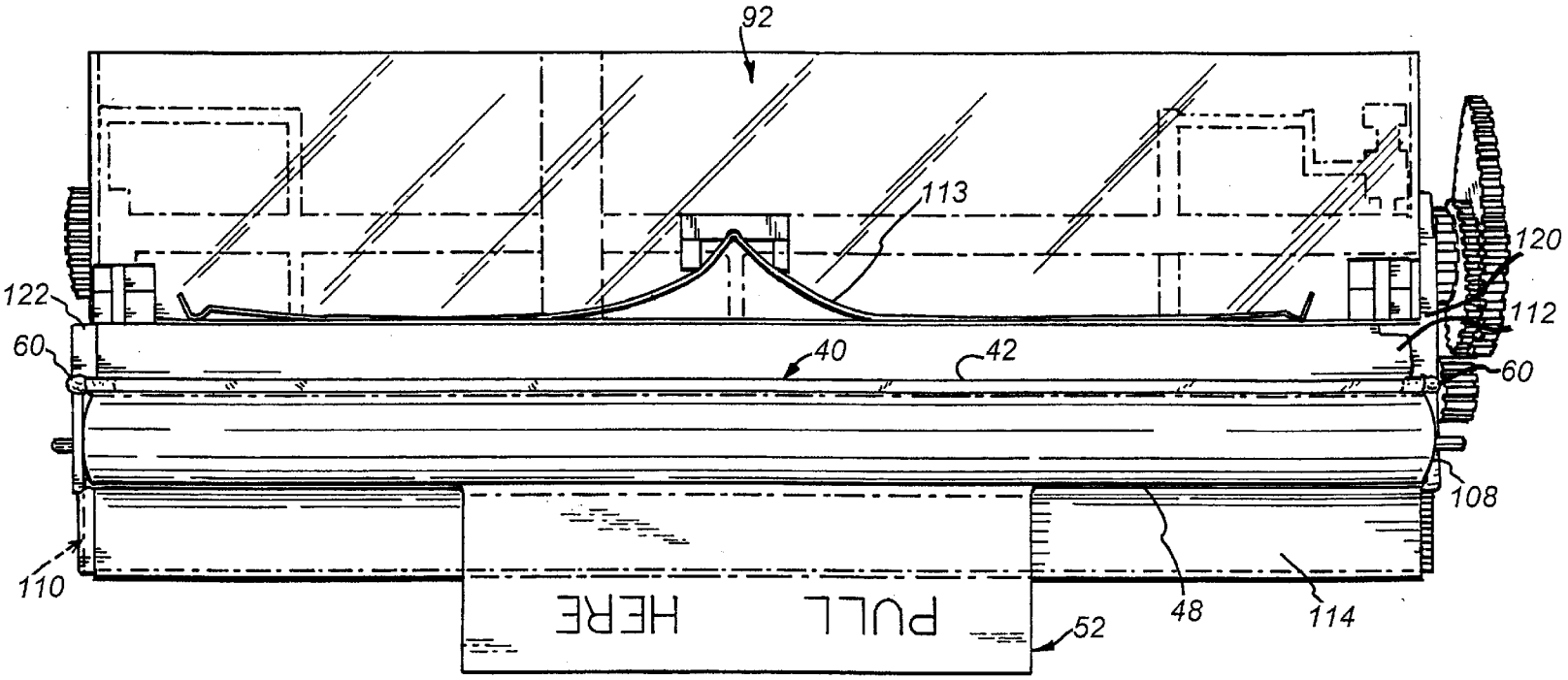
FIG. 7 is an exposed front view of the toner tank and developer roller assembly with the seal in place.

With reference to FIGS. 5, 6 and 7, the seal 40, according to one embodiment is shown in engagement with the developer roller assembly 90 of an exemplary printer toner cartridge. The cartridge toner tank 92 holds toner particles that are moved toward an outlet slot 94 by a moving agitator 96. The slot 94 is defined by a pair of Mylar® or similarly flexible sealing flaps 98 and 100. These flaps 98, 100 bear against a rotating metering structure known as a D-roller 102 that includes a pair of opposing flats 104 that face the slot 94 during alternating 180° rotations. A given amount of toner falls through the slot 94 onto one of the flats 104 of the D-roller 102 providing a relatively metered batch of toner to the developer roller section 90. As noted above, the printer toner cartridge described herein is used, particularly in the IBM 4019/4028/4029/4039/4049 series printers. However, the seal described herein can be adapted to a variety of systems using differently designed developer roller arrangements as will be described further below.

The D-roller 102 delivers toner to a porous foam applicator roller 106. The foam roller 106 is maintained in resilient contact with both the D-roller and the metering or developer roller 108. The developer roller 108 is made electrostatically attractive so that a predetermined amount of polarized toner adheres to its surface. The developer roller 108 then transfers toner to the photosensitive drum 110 (FIG. 6 and shown in phantom in FIG. 7) to fill electrostatically charged areas of the photosensitive drum 110, forming an image. The exemplary printer cartridge includes a doctor blade 112. The doctor blade 112 scrapes off excess toner on the developer roller 108. The blade 112 touches the developer roller under the pressure of a leaf spring 113. In some cartridges, a fixed gap is provided. However, for the purposes of this description, the term "gap" shall be construed to include an approximately zero-clearance gap as shown, since some small gaps are always present between the pressurized doctor blade 112 and developer roller 108, and between the toner application roller 106 and developer roller 108. A lower Mylar® sealing flap 114 is also located in a closely spaced arrangement adjacent the bottom of the developer roller 108.

The seal 40 according to this embodiment is wrapped around the developer roller 108 so that the fold edge 42 extends forwardly slightly (0.1–0.3 inch) beyond the doctor blade 112 and the front edge 48 of the seal 40 extends out from between the developer roller 108 and the photosensitive drum 110. The width of the seal 40 is chosen so that it extends across substantially the entire width of the developer roller 108. The length of the seal, which is approximately three to five inches in this embodiment, is sufficient to enable the seal 40 to be wrapped around the roller 108 with the front edge 48 located beyond the nip 125 (FIG. 6) between the photosensitive drum 110 and develop roller 108. Each foam projection 60 extends beyond the width of the developer roller 108 so that it bears tightly against a respective of the side walls 120 and 122 (see FIG. 7) of the cartridge frame. The foam, thus, crushes to seal any gap between the side walls 120 and 122 and the side edges 50 of the seal 40. It is contemplated that the size and shape of the projections 60, as well as their material, can be varied based upon the resilience of the material and the shape of the cartridge and sidewalls.

The foam projection 60, as shown in FIG. 6, also help increase the thickness of the seal plies 44 and 46 at the fold edge 42 with an air space 127. In other words, the foam projections 60 cause the material to "balloon" along the fold edge 42. This ballooning helps to form a tight seal between the doctor blade 112 and the developer roller 108. The seal 40 also passes between a developer roller 108 and the foam roller 106 at their impingement point 126. By filling any gaps between the doctor blade 112 and the developer roller 108 and between the developer roller 108 and foam roller 106, the seal positively isolates the developer roller section 90 from the outside. Thus, any toner that is able to slip through the tank slot 94 is stopped by the seal 40. The foam projections 60 fill the gap, since they lock positively against the sidewalls 120 and 122 of the cartridge frame. Further sealing occurs where the Mylar® flap 114 bears against the developer roller 108 since the seal fills most or all of the gap therebetween.

Figure 8:
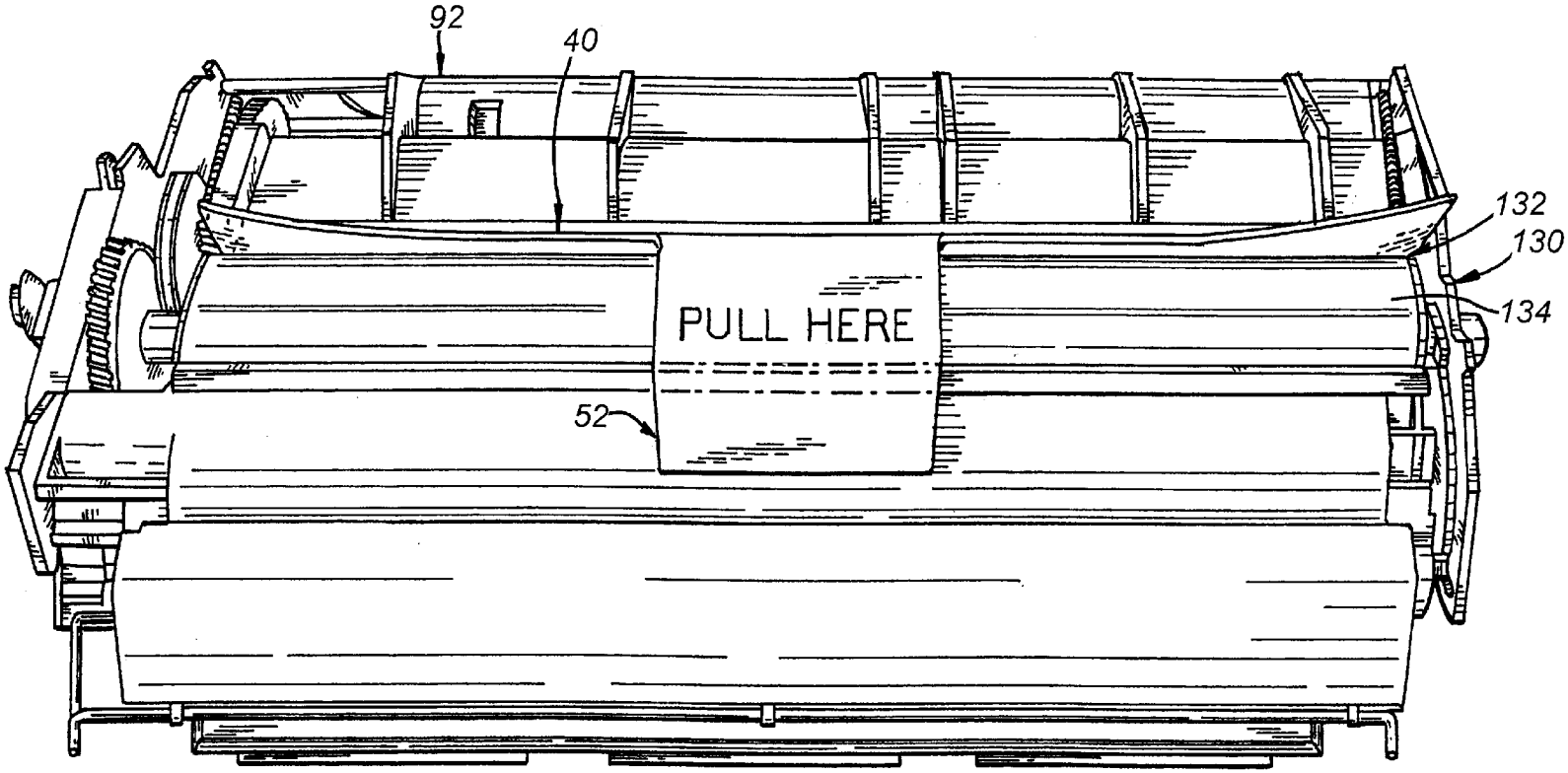
FIG. 8 is a partial bottom perspective view of a printer toner cartridge having the seal in place according to this invention.

Since the seal 40 is formed from a flexible, thin sheet material, it can be easily removed when the cartridge is ready for use. As further detailed in FIG. 8, the pull tab 52 extends outwardly from the bottom of the cartridge 130 through the slot 132 in the image drum's movable protective door 134. It is clearly visible upon handling the cartridge 130. The tab 52 is pulled outwardly away from the cartridge, sliding the seal around the developer roller 108, between the toner application roller 106, and out of the slot 132. The foam projections 60 are soft enough to provide minimal resistance to the pulling action and crush to pass easily under the doctor blade 112 and toner application roller 106. Similarly, the spring 113 of the doctor blade 112 will allow the blade 112 to displace as the projections 60 pass thereunder during removal. Polyethylene or another sturdy polymer has a sufficiently low friction coefficient relative to the developer roller to allow the seal 40 to slide easily along the developer roller without damaging it or the image drum 110. Hence, by a simple pulling action which removes the seal from the cartridge 130, the cartridge is now ready for use.

As noted above, an alternate embodiment of the seal as detailed in FIG. 4 can be filled with air or a similar pressurized gas to provide an inflated seal 70. By inflating the seal, the two plies can expand to further fill any gaps between the doctor blade 112, foam toner application roller 106, Mylar® 114 flap and image drum 110, with respect to the developer roller 108.

As noted above, the seal according to this invention is designed to be placed into the printer toner cartridge at time of manufacture or remanufacture and removed upon delivery or use by an end-user. Installation of the seal into a cartridge is generally only performed at the time of manufacture or remanufacture. To install the seal, it can be wrapped around the developer roller as the developer roller is installed into the cartridge. Conversely, a special semi-rigid shim constructed from metal, Mylar® or another flexible polymer (not shown) can be used to drive the seal around an assembled developer roller assembly until the fold edge 42 extends outwardly from the doctor blade 112. Such a shim could be curved to wrap around the developer roller 108. It, typically, would bear against the inside of the fold edge 42 to drive it up around the roller 108 and to generate a gap at the doctor blade 112 by pushing against the spring 113. The shim would be removed by reversing its travel once installation of the seal is completed. In any installation technique, it is desirable to orient the fold edge 42 so that the foam projections 60 are properly aligned relative to the cartridge frame sidewalls 120 and 122 and the ballooned part (127 in FIG. 6) of the fold edge 42 is positioned in engagement with the outer face of the blade 112.

While a two-ply seal is shown and described, a one-ply seal or multi-ply (three or more plies) seal can be utilized. It is desired, primarily, that the plies be sufficient to fill the gap between the doctor blade and developer roller and any other gaps that must be sealed to close of the developer roller section 90. Additionally, while foam projections 60 are shown and described, it is contemplated that other pliable end stops can be used, or that a very closely conforming integral structure in the seal material can be used at each sidewall.

Likewise, the seal can be formed from a variety of materials including paper, fabric, composite materials, fibrous materials, and a variety of polymers. As used herein, the term "thin sheet material" shall refer to any material having sufficient flexibility to be wrapped around a developer roller and to be completely removable by a pulling action that slides the seal relative to the developer roller. Such a thin sheet material should also be of a thickness, when formed in an appropriate number of plies, to fill gaps between the developer roller and closely spaced or impinging structures.

Furthermore, while an IBM model printer toner cartridge is shown herein, it is contemplated that the seal according to this invention can be used with a variety of toner cartridges, both monochrome and multicolored. It is desired primarily that such cartridges have a developer roller or similar metering structure adjacent an photosensitive drum and that a seal can be wrapped around such a metering roller so that it fills gaps between the roller and closely-spaced or impinging structures. For example, an SX-type cartridge can have a seal provided between the doctor blade and the developer roller and between the photosensitive drum, itself, and the developer roller. In addition, cartridges like the SX can be provided with filler material that generates a closely spaced structure adjacent the developer roller in an otherwise, open area. The filler material can provide a surface against which the seal can bear to close the gap. The cartridge need not include a D-roller or other toner application rollers to utilize the seal according to this invention and the seal can be used in conjunction with a roller that is in direct contact with the toner tank. In such an embodiment, the seal would typically face a feed slot of the toner tank, itself. The seal of this invention is effective because it closes off one of the outermost portions of the photosensitive mechanism in a positive manner, but since the outermost area is most accessible, it makes the seal easy to remove.

Figure 9:
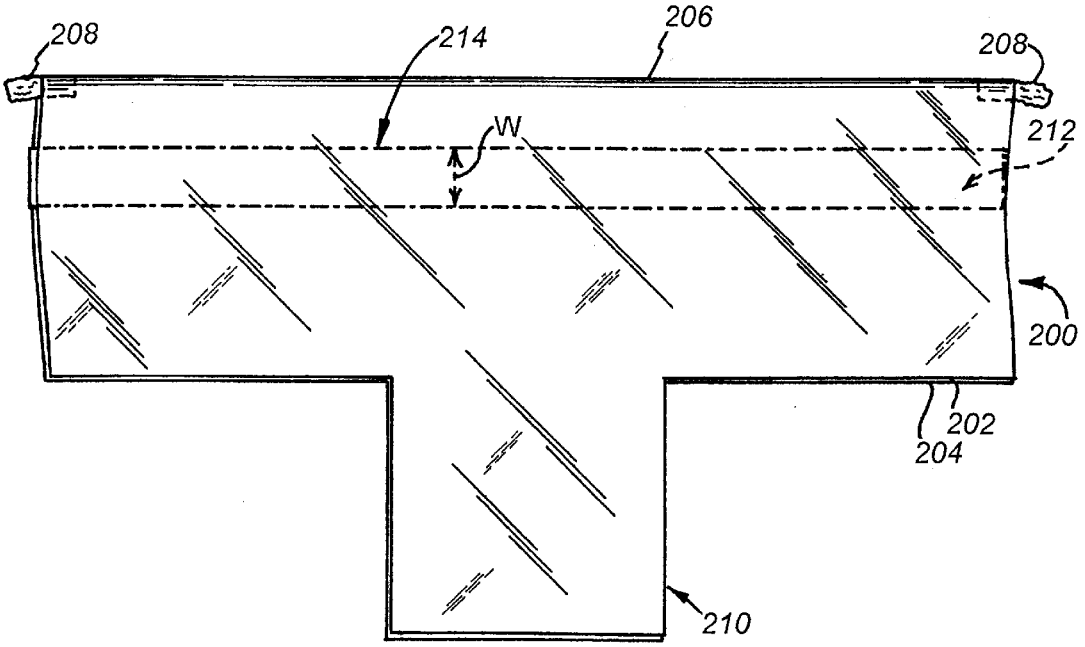
FIG. 9 is a printer toner cartridge seal according to an alternate embodiment of this invention.

FIG. 9 illustrates an alternate embodiment of a toner cartridge seal according to this invention. The seal 200 comprises two folded plies 202 and 204 of flexible material similar to that described above. The front fold 206 of the seal 200 joins the two plies. The seal can be otherwise sealed for inflation or the two plies can be left open as shown. A pair of foam projections 208, of a type generally described above, can be provided at the front edge 206. A pull tab 210 is also provided. In this embodiment, the pull tab is formed as a continuous integral feature of each of the two plies 202 and 204. Alternately, an adhered pull tab, as described above, can be provided.

According to this embodiment, a compressible, supplementary strip 212 (shown in phantom) is provided between the two plies. The strip 212 is preferably composed of a closed cell foam commercially available. Adhesive can be applied to one or both sides of the strip so that it, likewise, is joined to one or both plies 202 and 204 of the seal. The width W of the strip can be varied. According to one embodiment, the width is approximately ½ inch–¾ inch. Any acceptable width is contemplated, however. The front edge 214 of the strip 212 is spaced from the edge 206 of the seal by a distance of approximately ¾ inch. This distance can vary as described below.

Figure 10:
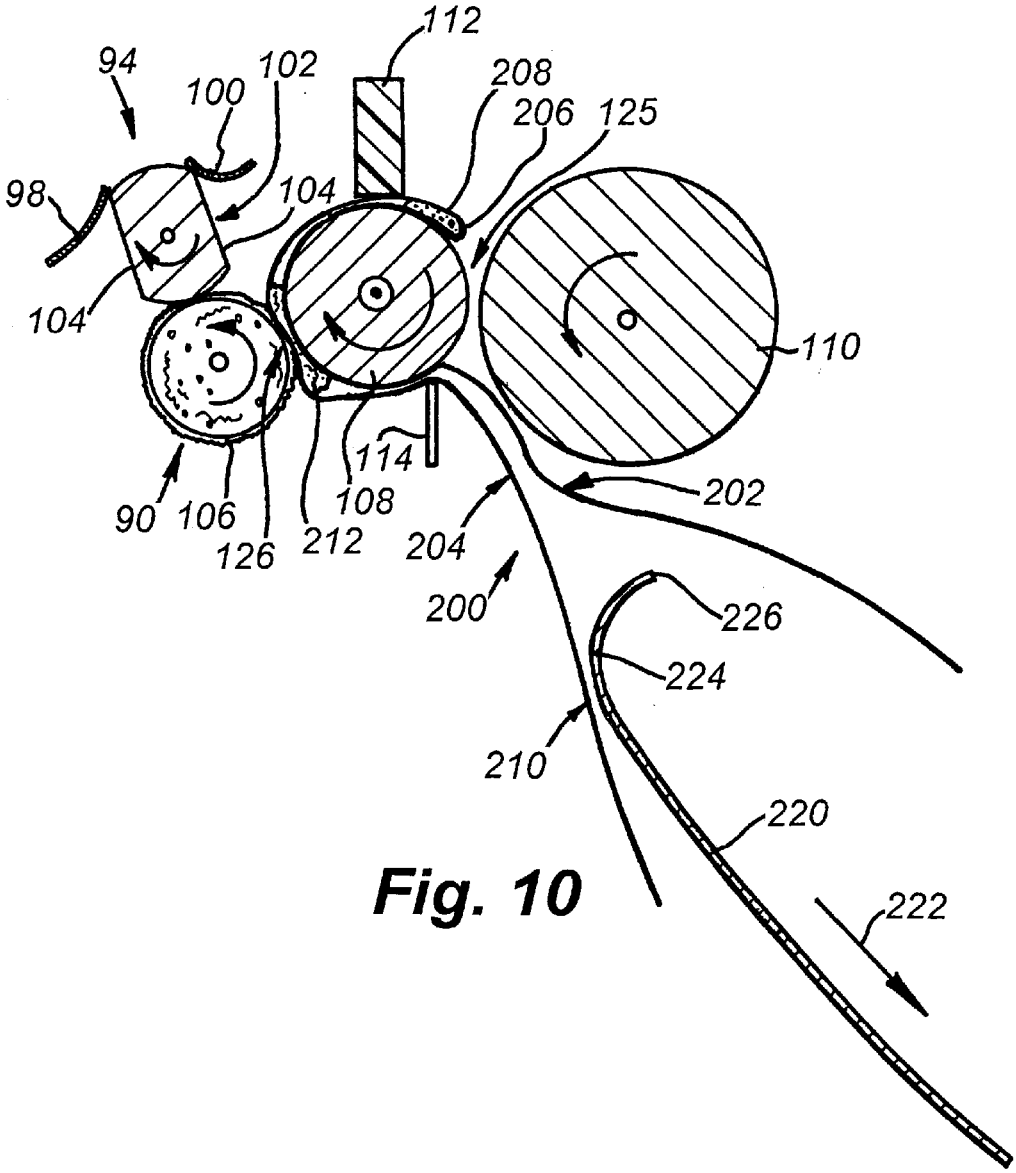
FIG. 10 is a partial side cross-section of the seal of FIG. 9 engaging the developer roller assembly.

A side cross-section of the developer roller 108, image drum 110 and related components is shown again in FIG. 10. Like components are given like names as those shown, for example, with reference to FIG. 6.

The seal 200, when installed, is wrapped around the developer roller 108 in the same manner as that described above with reference to FIG. 6. The end projections 208 are located fowardly of the blade 112. A balloon-like seal is formed between the blade 112 and the developer roll adjacent the projections 208. As noted above, the projections 208 serve to seal the width wise comers of the impingement point between the developer roll and the blade.

The foam strip 212 is located so that, when the seal is located in the proper position as depicted, the strip is positioned adjacent the impingement point 126 between the developer roller and the application roller 106. The soft surface of the application roller 106, in combination with inherence spring force imparted by the compressed strip 212 causes the two plies 202 and 204 to become tightly engaged between the developer roller 108 and the application roller 106, respectively. This forms a positive seal at the impingement point 126. It should be clear that the location of the strip 212, along with its width determines where it will reside with respect to the rollers. It is contemplated that the strip can be provided between other sets of rollers at appropriate impingement points therebetween. In this embodiment, the location and width of the strip are chosen to seat it within the impingement point 126.

As described above, an insertion shim 220 is also depicted. In this case, it is being withdrawn (arrow 222) from the toner cartridge. The front edge of the shim 224 includes a hook shape that enables it to be "snaked" around the developer roll. It is located between the two plies 202 and 204 during insertion. The tip 226 of the hook 224 engages the inside edge of the seal front fold edge 206. The hook 224 enables the seal located thereover to pass around respective nips formed between the developer roller 108 and the structures 114, 106 and 112. In this embodiment, at least a portion of one ply 202 or 204 remains unjoined to the strip 212 so that the shim could pass over it and into engagement with the front edge 206. The shim is constructed from a spring steal or flexible plastic. In one embodiment it has a thickness of approximately 0.10 inch and a width (taken along the axis of rotation of the respective rollers) are from 3–4 inches.

Figure 11:
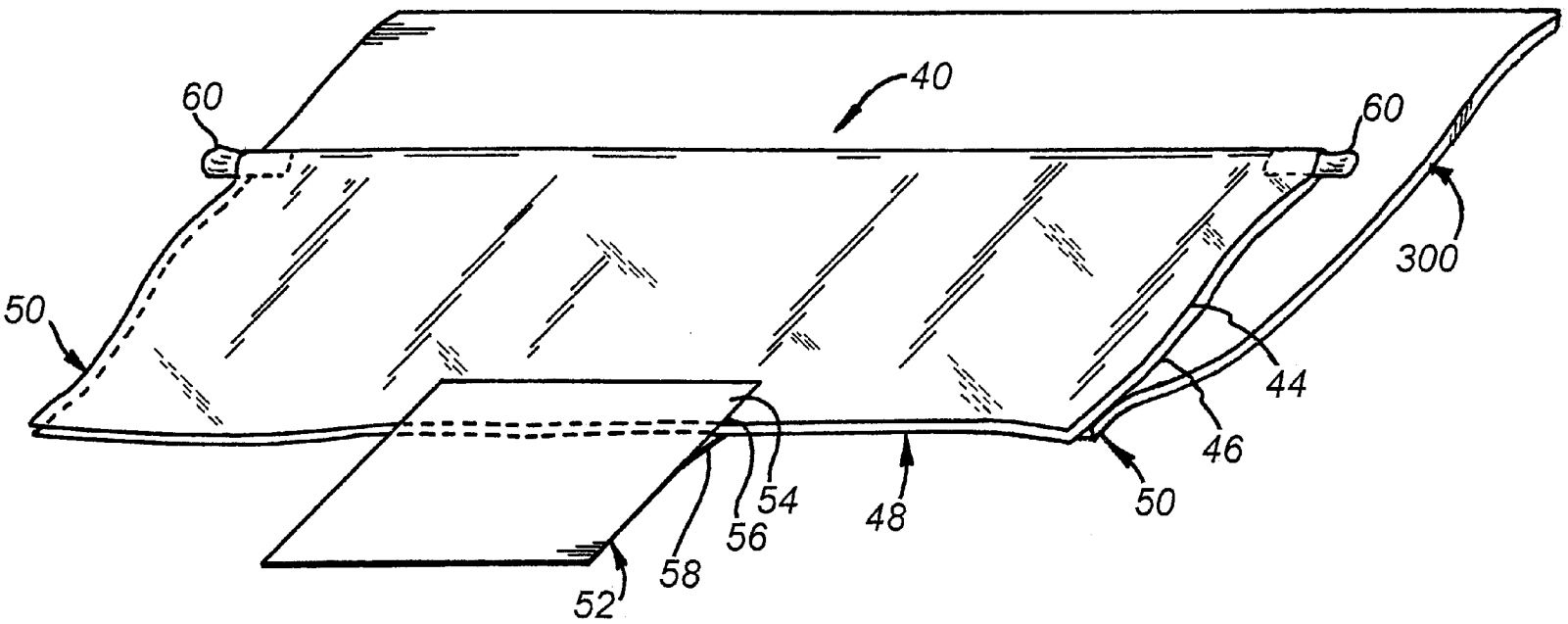
FIG. 11 is yet another alternate embodiment of a toner cartridge seal according to this invention.
Figure 12:
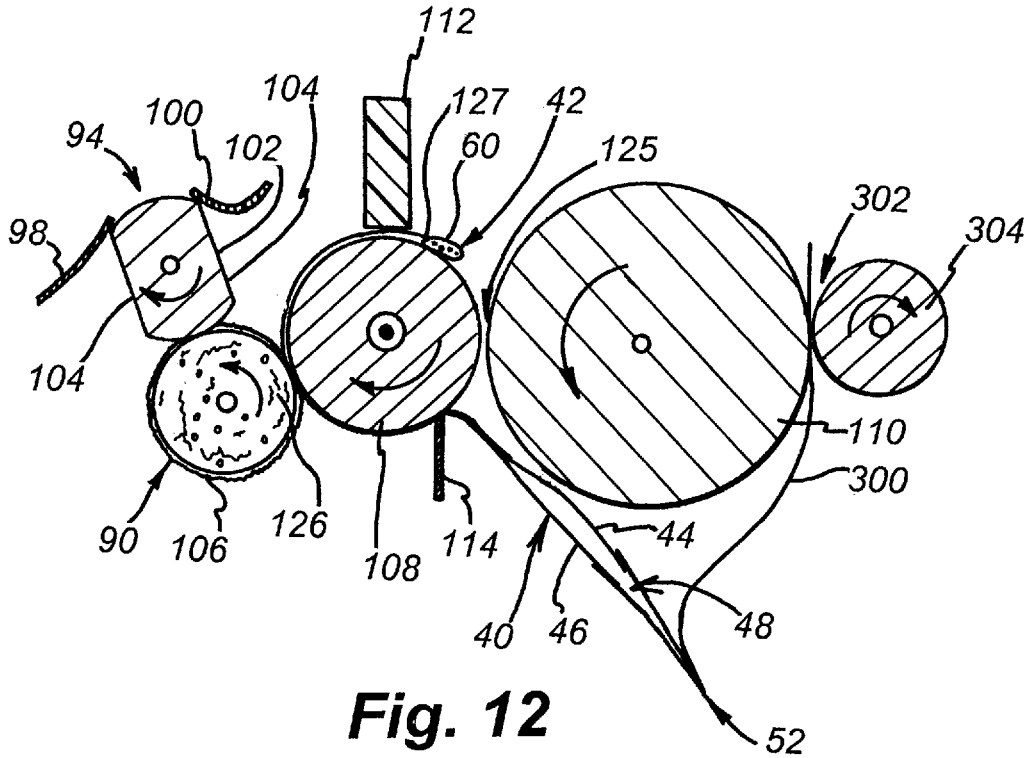
FIG. 12 is a partial side cross-section of the seal of FIG. 11 engaging the developer roller assembly and the cartridge's primary charge roller.

FIGS. 11 and 12 show a further improvement of the seal shown, for example, in FIG. 2. Like reference numbers have been used in this embodiment where appropriate. The improvement shown in this embodiment can be applied to any of the seals described herein including that of FIGS. 9 and 10 have the supplemental foam strip. The seal 40 includes a further material piece 300 that is joined at the edge 48 according to this embodiment. The adhered tab 52 can secure the new layer 300 as well as the two plies 44 and 46 of the seal 40. Conversely, integral tabs can be formed on each ply as well as the layer 300. The layer 300 is typically longer than the two plies 44 and 46. The total length of the layer 300 can be approximately 5 inches. Greater or less length are contemplated. The layer 300 as detailed in FIG. 12 passes between the impingement point 302 formed between the image drum 110 and the primary charge roller 304 used to provide a charge to the photosensitive drum 110 according to this example.

The layer 300 can also comprise a Mylar® layer having a thickness similar to that of the two plies. Where appropriate, a thicker or thinner layer can also be used to enhance the sealing of the impingement point 302. Upon withdrawal of the seal 40 the layer 300 is also pulled out from between the photosensitive drum and the primary charge roller 304. While toner leakage does not occur substantially at the impingement point 302, it has been found that providing a boundary between the primary charge roller 304 and the photosensitive drum 110 enhances long-term storage of a cartridge by reducing the negative effects of a possible chemical reaction on a specific line of the photosensitive drum adjacent the impingement point 302. Appropriate coatings can be applied to the layer 300 to further enhance the shielding effect when appropriate. It is contemplated that the layer 300 can also comprise two separate plies. For the purposes of this example a layer 300 having one ply is shown.

The foregoing has been a detailed description of a preferred embodiment. Various modifications and additions can be made without departing from the spirit and scope of this invention. For example, the seal of this invention can be utilized with cartridges that dispense one-part, two-part, magnetic or nonmagnetic toners. The cartridges can be used in printers, faxes, photocopiers or other image transfer devices. The foam projections described herein can be substantiated with a similar pliable/crushable sealing material such as felt, cotton waddling or fabric. The seal can be supplemented with a low-tack adhesive that engages the cartridge elements. Finally, while the depicted side edges of the seal extend substantially the entire width of the developer roller, it is expressly contemplated that the side edges can be narrowed in areas that are not adjacent gaps to be filled, forming an "H" or "T" configuration (not shown). Accordingly, this description is meant to be taken only by way of example and not to otherwise limit the scope of the invention.

What is claimed is:

1. A toner cartridge seal for a toner cartridge having a toner metering roller that defines a predetermined width, and closely spaced surfaces adjacent the metering roller, the seal comprising:

a thin sheet material having two plies sized and arranged to wrap around the metering roller with opposing side edges that, along at least a portion thereof, are spaced apart a distance approximately equal to the predetermined width of the metering roller and having a thickness that, when wrapped around the metering roller in a predetermined orientation, spans a plurality of gaps formed between a surface of the metering roller and the closely spaced surfaces respectively to seal each of the gaps against passage of toner therethrough with each of the two plies engaging respectively each of the metering roller and the closely spaced surfaces; and a compressible strip positioned between the two plies adjacent one of the closely spaced surfaces.

2. The seal as set forth in claim 1 wherein one of the closely spaced surfaces comprises a doctor blade.

3. The seal as set forth in claim 2 wherein another of the closely spaced surfaces comprises a resilient toner application roller.

4. The seal as set forth in claim 1 further comprising a pull tab, extending from an edge of the thin sheet material, constructed and arranged to extend outwardly from the toner cartridge.

5. The seal as set forth in claim 1 further comprising a pair of soft, pliable projections that extend outwardly beyond the side edges to seal against walls of the toner cartridge.

6. The seal as set forth in claim 5 wherein the projections comprise foam projections.

7. The seal as set forth in claim 1 further comprising a layer attached to an end of the two plies outwardly of the metering roller and extending between a gap formed between a pair of rollers of the cartridge.

8. The seal as set forth in claim 7 wherein the pair of rollers comprise a photosensitive drum and a primary charge roller.

9. The seal as set forth in claim 1 wherein the metering roller comprises a developer roller.

10. In combination, a toner cartridge and a removable seal comprising:

a toner tank having a toner feed slot;

a photosensitive drum for delivering toner in patterns to a predetermined surface;

a toner metering system that transfers toner from the toner tank to the photosensitive drum in predetermined metered quantities, the metering system including metering components and fixed components with gaps defined between at least some of the metering components;

a flexible thin sheet material wrapped around at least one of the metering components and having two plies spaced at a thickness that substantially fills at least some of the gaps to block exit of toner through the gaps, the sheet having a free end located outwardly of the photosensitive drum at a location along an exterior of the toner cartridge whereby the thin sheet material is constructed and arranged to be removed from the metering component by pulling on the free end to slidably move the thin sheet material relative to the gaps; and a compressible material strip located between each of the two plies with respect to one of the gaps.

11. The combination as set forth in claim 10 wherein the metering system includes a developer roller and wherein the thin sheet material is wrapped around the developer roller.

12. The combination as set forth in claim 11 wherein the metering components include a doctor blade.

13. The combination as set forth in claim 12 further comprising a resilient toner application roller and wherein the thin sheet material is located between the developer roller and the toner application roller.

14. The combination as set forth in claim 10 further comprising a primary charge roller and wherein a gap is defined between the photosensitive drum and the primary charge roller and comprising a layer joined to the seal adjacent the free end and extending into the gap between the photosensitive drum and the primary charge roller.

15. The combination as set forth in claim 10 wherein the toner cartridge includes respective side walls and further comprising a pair of crushable projections that extend outwardly away from the thin sheet material in engagement with the respective side walls the projections being located between each of the two plies.

16. The combination as set forth in claim 10 further comprising a projecting pull tab located along the free end.

17. A method for removably sealing a toner cartridge having a photosensitive drum, a toner metering system that delivers toner to the photosensitive drum and side walls that rotatable support the photosensitive drum and toner metering system, comprising the steps of:

locating a thin seal having two plies and a front fold therebetween in engagement with gaps defined in the metering system including positioning the thin sheet material so that a free end of the thin sheet material is located outwardly of the photosensitive drum including directing a shim having a curved end around a metering roller with two plies of the material over the shim and an end of the shim engaging the front fold; and positioning the front fold with respect to the side walls so that a pair of opposing pliable projections, that are located between the two plies at the front fold and that extend beyond side edges of the two plies and that also define a ballooned area between the two plies at the front fold, crushably engage the side walls and locating the front fold adjacent to one of the gaps so that the ballooned area engages one of the gaps to thereby further seal the one of the gaps.

18. The method as set forth in claim 17 further comprising providing a sheet layer joined to the seal between a photosensitive drum and a primary charge drum of the cartridge.

19. The method as set forth in claim 17 wherein the step of positioning the thin sheet material includes locating the thin sheet material so that a compressible strip positioned between the two plies remote from the front fold is located adjacent another of the gaps to further seal the other of the gaps.

* * * * *